US008557956B2

(12) United States Patent
Cheng et al.

(10) Patent No.: US 8,557,956 B2
(45) Date of Patent: Oct. 15, 2013

(54) ALIGNED POLYMERS INCLUDING BONDED SUBSTRATES

(75) Inventors: Xingguo Cheng, San Antonio, TX (US); Vasiliki Z. Poenitzsch, Alamo Heights, TX (US)

(73) Assignee: Southwest Research Institute, San Antonio, TX (US)

( * ) Notice: Subject to any disclaimer, the term of this patent is extended or adjusted under 35 U.S.C. 154(b) by 496 days.

(21) Appl. No.: 12/813,834

(22) Filed: Jun. 11, 2010

(65) Prior Publication Data

US 2011/0306754 A1 Dec. 15, 2011

(51) Int. Cl.
*C07K 14/00* (2006.01)

(52) U.S. Cl.
USPC ..... 530/300; 977/700

(58) Field of Classification Search
None
See application file for complete search history.

(56) References Cited

U.S. PATENT DOCUMENTS

| | | | | |
|---|---|---|---|---|
| 4,627,472 | A | 12/1986 | Goetler et al. | |
| 5,205,921 | A | 4/1993 | Shirkanzadeh | |
| 6,203,814 | B1 | 3/2001 | Fisher et al. | |
| 6,383,577 | B1 * | 5/2002 | Chidichimo et al. | 428/1.1 |
| 7,125,533 | B2 | 10/2006 | Khabashesku et al. | |
| 7,452,519 | B2 | 11/2008 | Khabashesku et al. | |
| 7,601,421 | B2 | 10/2009 | Khabashesku et al. | |
| 7,611,906 | B2 | 11/2009 | Yaniv | |

FOREIGN PATENT DOCUMENTS

WO 2009073548 6/2009

OTHER PUBLICATIONS

Sridharan, "Adapting collagenICNT matrix in directing hESC differentiation," Biochem Biophys Res Commun, Apr. 17, 2009; 381(4): 508-512.

Hirata et al., "Development of a 3D collagen scaffold coated with multiwalled carbon nanotubes," Journal of Biomedical Materials ResearchPart B: 90B: 629-634, 2009.

MacDonald, "Collagen-carbon nanotube composite materials as scaffolds in tissue engineering," Published online Jun. 22, 2005 in Wiley InterScience (www.interscience.wiley.com). (8 pages).

Twomey, et al., "Evaluation of Nanostructural, Mechanical and Biological Properties of Collagen-Nanotube Composites." IEEE Trans Nanobioscience Mar. 8, 2010 (abstract).

Da Silva, et al., "Nanostructured 3-D Collagen/Nanotube Biocomposites for Future Bone Regeneration Scaffolds," NanoRes (2009) 2: 462-473.

* cited by examiner

*Primary Examiner* — Anand Desai
(74) *Attorney, Agent, or Firm* — Tucker Grossman et al.

(57) ABSTRACT

The present disclosure relates to the present disclosure relates to a method of fabricating an aligned polymer containing a bonded substrate and related compositions. The method involved placing a polymer in solution which is capable of alignment wherein the polymer is also bound to a selected substrate. This may then be followed by placing the polymer solution in an electrochemical cell wherein the polymer solution is in contact with at least one electrode and applying an electric field/voltage to the polymer solution and generating a pH gradient wherein the polymer and bonded substrate positions at the isoelectric point of the polymer in solution.

28 Claims, 15 Drawing Sheets

ALIGNED POLYMERS INCLUDING BONDED SUBSTRATES

FIELD OF THE INVENTION

The present invention relates to aligned polymers including bonded substrates. The aligned polymers may include polypeptides and proteins such as collagen and the bonded substrates may include any compound or structure capable of bonding to the aligned polymeric material. The substrates may specifically include nanoparticles and/or nanotubes which have been functionalized to chemically bond to the aligned polymers and which substrates may therefore now become directionally orientated.

BACKGROUND

Aligned collagen constructs by electrochemical methods are described in WO 2009/073548 entitled "Aligned Collagen And Method Therefor", with an international publication date of Jun. 11, 2009. According to the procedures identified therein, an aligned collagen may be formed by electrochemical methods. The aligned collagen fibrils are described as being anisotropic and to include certain fibril area fractions and to display certain mechanical properties, such as ultimate tensile strains, elastic or linear modulus values including methods of preparation utilizing electrochemical cells.

The present disclosure, among other things, significantly extends such earlier reports on aligned collagen systems and provides compositions and methods which allow for the general assembly of aligned polymer systems, which may utilize collagen, and which are now chemically associated with other substrates, and which may therefore provide a whole new class of aligned polymer-substrate systems.

SUMMARY

In one exemplary embodiment, the present disclosure relates to a method of fabricating an aligned polymer containing a bonded substrate comprising providing a polymer in solution wherein the polymer is bound to a selected substrate. This may then be followed by placing the polymer solution in an electrochemical cell wherein the polymer solution is in contact with at least one electrode and applying an electric field to the polymer solution and generating a pH gradient wherein the polymer and bonded substrate positions at the isoelectric point of the polymer in solution.

In another exemplary embodiment the present disclosure relates to a method for alignment of a polymer in solution containing a bonded substrate comprising placing the polymer solution containing the bonded substrate between a first and second electrode. This may then be followed by application of a voltage to the first and second electrodes and producing an electric field between the electrodes and aligning the polymer containing said bonded substrate at the polymer's isoelectric point.

The present invention also relates to a composition of aligned polymers bonded to nanotubes or nanoparticles wherein the level the nanotubes or nanoparticles present at a level of 0.01 wt % to 99 wt. %. In addition, the aligned polymer may include collagen. The carbon nanotube-collagen conjugates may provide a directional orientation of the carbon nanotubes and provide a formed article of the carbon nanotube-collagen conjugates which better serves a particular purpose. Articles formed of the CNT-collagen conjugates may have uses for therapeutic applications involving therapeutic (e.g. drug, protein, gene) delivery, as well as tissue engineering/regenerative medicine (i.e. creating living, functional tissues to restore, maintain or enhance tissue or organ function lost due to age, disease, damage, or congenital abnormality or disorder) such as involving bone, neurons, organs and muscle. The formed article may have uses for diagnostic applications (e.g. such as for biosensors, or for testing drug metabolism and uptake, toxicity, and pathogenicity).

BRIEF DESCRIPTION OF THE DRAWINGS

The above-mentioned and other features of this disclosure, and the manner of attaining them, will become more apparent and better understood by reference to the following description of embodiments described herein taken in conjunction with the accompanying drawings, wherein.

DETAILED DESCRIPTION

Figure 1:
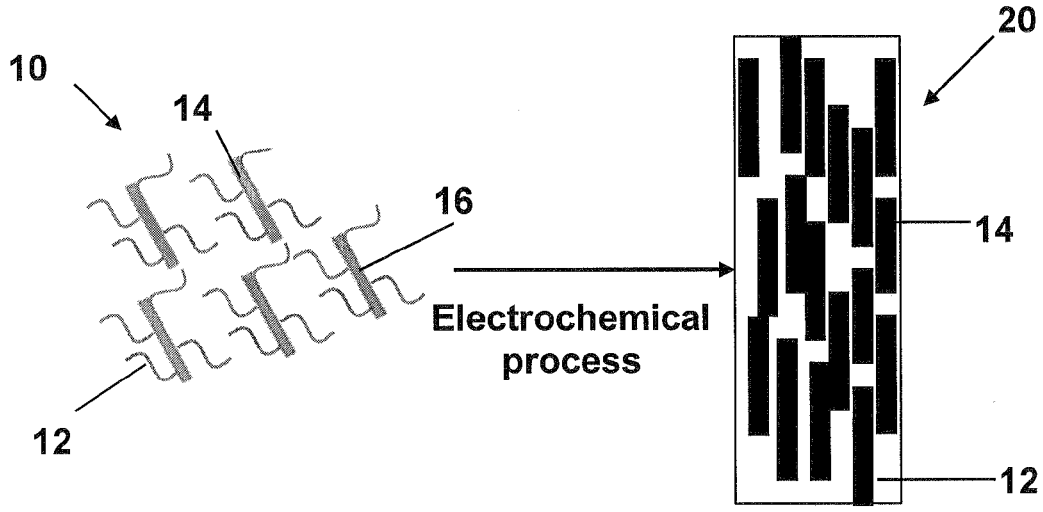
FIG. 1 is a schematic drawing showing CNT-collagen conjugates which may be introduced to an electrochemical process to produce a CNT-collagen article.

It may be appreciated that the present disclosure is not limited in its application to the details of construction and the arrangement of components set forth in the following description or illustrated in the drawings. The embodiments herein may be capable of other embodiments and of being practiced or of being carried out in various ways. Also, it may be appreciated that the phraseology and terminology used herein is for the purpose of description and should not be regarded as limiting as such may be understood by one of skill in the art.

As noted above, the present disclosure relates to aligned polymers including bonded substrates. The aligned polymers containing bonded substrates may include those polymers capable of alignment in an electric field and preferably involve polypeptides and proteins such as collagen. The bonded substrates may include any chemical compound or structure capable of bonding to the electrochemically aligned polymeric material. In the case of a structure, such as nanoparticles or nanotubes, such may be functionalized to bond to the polymeric material which polymer material, as noted, may then be electrochemically aligned.

The polymer alignment noted herein may be preferably achieved according to electrochemical methods and reference is again made to WO2009/073548. More generally, the alignment may be achieved by providing an aqueous (e.g. distilled water) solution of polymer capable of alignment (e.g. a protein such as collagen), placing the solution into an electrochemical cell wherein the solution is in contact with at least one electrode, applying an electric field wherein the current density is 0.3 $A/m^2$ to about 34 $A/m^2$ and generating a pH gradient in the solution, wherein the polymer positions at the isoelectric point of the polymer in the solution. The isoelectric point (pI), sometimes abbreviated to IEP, is the pH at which a particular polymer carries no net electrical charge. The amount of polymer in the solution may be in the range of 0.5 mg/ml to 6 mg/ml, the electric field strength may be 100 V/m to 30 KV/m, the voltage applied to the electrochemical cell may be at least 1.2 V, one electrode may be tubular, the at least one electrode may be two linear electrodes, the electrodes may be parallel line electrodes, the at least one electrode may be in the form of a ring, the electrodes may be in the form of plates, the at least one electrode may be formed from carbon, stainless steel, gold plated metals, Mg alloy, platinum, any other conductive electrodes or combinations thereof.

An apparatus for aligning polymer molecules including bonded substrates is also disclosed herein, and may include a first electrode and a second electrode each in contact with a substrate, the first electrode and second electrode having a gap therebetween configured to receive the polymer solution, a moisture chamber having the substrate, the first electrode and the second electrode position therein, and a power supply electrically connected to the first electrode, the power supply configured to supply a voltage to the first electrode and the second electrode to create an electric field in the gap such that each polymer molecule received in the gap is aligned along its respective isoelectric point.

The apparatus may further include a resistive element connected to the power supply and one of the first and second electrodes, the substrate may be formed of glass, plastic, ceramic, metal or combinations thereof, the power supply may be a dc or ac power supply, the first electrode and second electrode may comprise a wire or plate or tube, the first electrode may be tubular and the second electrode may be positioned within the first electrode and extend along the longitudinal axis of the first electrode, the first electrode may comprise a loops and the second electrode may be positioned within such loop, the first and second electrodes may be formed from materials selected from the group consisting of carbon, stainless steel, gold, gold plated metals and platinum or any other conductive electrodes.

The method for alignment of the polymer molecules containing bonded substrates may include dispensing the polymer molecules with bonded substrates in a gap between a first and second electrode, applying a voltage to the electrodes to produce an electric field in the gap and controlling the voltage applied to the electrodes to align each polymer molecule along their respective isoelectric point.

As therefore alluded to above, the polymers capable of alignment herein include those polymers that may be aligned in the electric field at the polymer isoelectric point. Such polymers may therefore preferably include those polymers capable of assuming a defined polarity and then orientating with respect to an anode or cathode electrode. Such polarity preferably includes the development of a net positive and/or negative charge, such that the polymer may then align, as noted herein, at their respective isoelectric point. Preferably, such polymers may include polypeptides and proteins and more specifically collagen, and for the purpose of this disclosure, collagen has been utilized to demonstrate the general characteristics of alignment of the herein described polymers now containing a bonded substrate. However, while collagen is preferably utilized it can be readily appreciated that the present disclosure extends to polymers which when in aqueous solution may be exposed to an electric field and pH adjustment and undergo alignment and which alignment may then be imposed upon any selected bound substrate.

The pH for electrochemical alignment may be selected from a range of 3.0 to 11.0, and more preferably, at a range of 6.0 to 9.0. In certain embodiments the pH range may preferably be in the range of 7.0 to 8.5, and more particularly, at a level of 7.3 to 7.4. The polymer in the aqueous solution within the electrochemical cell may be present at a concentration of 0.1 mg/ml to 10 mg/ml or higher. The aligned polymers of the present disclosure may indicate modulus values of 50 MPa to 1.5 GPa, including all values and increments therein in 100 MPa increments. Modulus may be understood as reference to the elastic modulus and the slope of the stress versus strain curve in mechanical testing. The tensile stress may be in the range of 0.5 MPa to 150 MPa, also in 100 MPa increments. Tensile strain values may vary between 0.05% to 30%. The density of the aligned polymer systems may be from around 1.0 g/mL to 3.0 g/mL.

With respect to the reference to collagen herein, such may be generally understood as a group of naturally occurring proteins found in connective tissue of animals, and containing three polypeptide chains in the form of a triple helix. The amino acid sequence in collagen typically follows the sequence Gly-Pro-X or Gly-X-Hyp where Gly refers to glycine, Pro refers to proline or hydroxyproline and X may be any of the various amino acid residues. The collagen herein may therefore be any type of collagen including collagen types I to XXVII, alone or in combination, or even collagen-mimic peptide. The collagen may contain endogenous or exogenously added non-collagen proteins (e.g. fibronectin, fibrinogen, ketain or silk proteins), glycoproteins, proteoglycans, polysaccharides, glycosaminoglycans (e.g. chondroitins and heparins).

In addition, as noted above, the polymers capable of alignment herein may be functionalized such that they may be covalently bonded to any given substrate, which substrate remains attached to the collagen during the above referenced electrochemical alignment. The substrates which may be covalently attached preferably include any chemical compound and/or specific structures such as nanotubes and/or nanoparticles. The substrates may also include nanowires, nanobelts, nanoribbons, and/or nanorods. The chemical compounds may preferably include polypeptides (synthetic or natural) and/or proteins. Nanotubes herein may be understood as any tubular type structure that has nanometer dimensions of diameter in the range of 1-999 nm, and more typically 1-100 nm. Such may therefore include, e.g., carbon nanotubes (CNT), inorganic nanotubes (e.g. metal oxides), DNA nanotubes and/or membrane nanotubes (a tubular membrane connection between cells).

Nanoparticles may be understood herein as any particle with diameters similarly in the range of 1-999 nm, and more preferably, 1-250 nm. The nanoparticles and/or nanotubes herein when functionalized and bonded to the alignable polymer chains noted herein may themselves be bonded to or associated with a pharmaceutically active ingredient (PAI), such as a drug or other therapeutic compound for targeted drug delivery. The level of nanoparticle and/or nanotube bonded to the aligned polymers herein may preferably be present in an amount of 25 wt. % or higher. However, the level of nanoparticles and/or nanotubes bonded to the aligned polymers may be in the range of 0.01 wt. % to 99 wt. %, and at all values therein, in 1.0 wt % increments.

Accordingly, while the substrates may include any one or more of the above referenced nano-type structures, for exemplary purposes only, the present disclosure identifies a representative CNT-collagen system, and it is again to be understood than any substrate bonded to the electrochemically alignable polymers noted herein may be employed.

In addition, the substrates may therefore include the above referenced structures (particles, wires, belts, ribbons, rods, and/or tubes) which have micron size characteristics. For example, particles with diameters of 1.0 μm to 100 μm, belts with thickness and widths of 1.0 μm to 100 μm, rods with diameters of 1.0 μm to 100 μm and tubes with diameters of 1.0 μm to 100 μm.

Referring now to FIG. 1, FIG. 1 shows CNT-collagen conjugates 10 comprising collagen molecules 12 and CNTs 14. To chemically bond the collagen 12 and CNTs 14, the surface 16 of the CNTs 14 may be first functionalized with at least one chemical functional group which is chemically joined, or linked, to the CNT 14.

More particularly, and as alluded to above, the chemical functional group of the substrate (e.g. any compound and/or the preferred nanotubes and/or nanoparticles) for bonding to the alignable polymers herein may preferably be an organic chemical functional group having acid functionality and/or at least one functional group having base functionality, which functional groups are capable of reacting to form covalent linkages. Accordingly if the alignable polymer (e.g. collagen) is functionalized to have acid functionality and the substrate for bonding (e.g. a CNT) contains base functionality, an acid-base reaction may now be triggered thereby leading to covalent attachment of the substrate (e.g. the nanotube) to the alignable polymer material (e.g. the collagen).

The organic acid chemical functional group may therefore preferably be a carboxylic acid functional group (—COOH) and the organic base functional group may preferably be an amine functional group (—$NH_2$) thereby leading to an amide type linkage (—NHCO—). It is therefore contemplated that one may also utilize, for example, an organic ester group (—COOR) where R is any alkyl or aromatic group and the basic group may be a hydroxyl functionality (—OH) thereby leading to ester type covalent linkages. Other covalent linkages may include those formed between any two or more organic functional groups as a consequence of a condensation and/or even addition type reaction between such functional groups. This may then include (1) formation of urethane linkages as between isocyanate and hydroxy functionality which relies upon the reaction of an isocyanate group (—NCO) and a hydroxy group (—OH); and/or (2) formation of urea linkages which rely upon the reaction of an isocyanate group (—NCO) with an amine group (—$NH_2$).

More specifically, while the functional groups may be positioned anywhere on or within the polymer for alignment as well as on or within a given substrate for bonding to the polymer, preferably, the surface of the nanoparticles and/or nanotubes such as surface 16 of the representative CNTs 14 may now be functionalized with an organic acid and/or organic base functional group(s) using established functionalization techniques. The CNTs 14 may also be single-walled nanotubes (SWNTs) or multi-wall nanotubes (MWNTs) including double-walled nanotubes (DWNTs). In other embodiments, the CNTs 14 may be completely replaced with other particles or chemical compounds that have surface functional groups for bonding with the collagen.

It may also be appreciated now that if the substrates for bonding to the alignable polymer such as the CNTs 14 have an organic base functional group and the preferred collagen 12 has an organic acid functional group, the organic base functional group of the CNTs 14 may react with an organic acid functional group of the collagen 12 and, with chemical conjugation, form CNT-collagen conjugates 10 again having covalent linkages. More particularly, an amine functional group on the surface of the CNTs 14 may react with a carboxylic acid functional group of the collagen 12 and, with chemical conjugation form CNT-collagen conjugates 10 having amide linkages wherein the amine residue is associated with the CNTs. FIG. 1 shows collagen molecules 12 which have been chemically bonded to CNTs 14 as set forth above to provide the CNT-collagen conjugates 10. Preferably, the collagen is dialyzed (i.e. purified to remove ions).

In other embodiments, the collagen 12 may be combined with, or completely replaced with, other molecules, such as other proteins that have functional group(s) that may react with chemical functional groups which are chemically joined to the CNTs 14. After chemical conjugation, CNT-collagen conjugates 10 may be introduced to the herein disclosed electrochemical process to provide a directional orientation of the CNTs and provide a formed article of the CNT-collagen conjugates 10 which better serves a particular purpose, such as in various medical applications, described herein.

More particularly, as shown in FIG. 1, the CNT-collagen conjugates 10 may be introduced to an electrochemical process to induce and otherwise generate an assembly of the conjugates 10, and particularly the CNTs 14 thereof, in such fashion relative to each other that the conjugates 10, and particularly the CNTs 14 thereof, may be directionally orientated in the resulting formed article 20.

Expanding on the above, the CNT-collagen conjugates 10 may be introduced to an electrochemical (deposition/coating) process to align the CNT-collagen conjugates 10 and form article 20. As a result of the electrochemical process, the CNT-collagen conjugates 10 may be isoelectrically focused and aligned to form collagen article 20 having increased density, as well as aligned CNTs 14 for increased strength as compared to random CNT-collagen conjugates 12.

A representative electrochemical process, and more particularly an electrochemical-electrochemical (deposition/coating) process, to form article 20 may be seen now in reference to FIG. 2. First, as shown in FIGS. 2(*a*) and 2(*b*), random CNT-collagen conjugates 10 may be fed into a chamber and an electrical voltage may be applied between two stationary electrodes 22, 24. In FIG. 2(*b*) one can see the development of polarity on the collagen. FIGS. 2(*c*) and 2(*d*) then show an exemplary aligning of the random CNT-collagen conjugates 12 between electrodes 22, 24 in the presence of the electrical voltage as CNT-collagen article 20 is fabricated. In the present embodiment, electrodes 22, 24 may comprise electrically conductive plate/wire members and article 20 may be fabricated in the form of a flat (planar) aligned sheet or aligned fiber. In the sheet form, article 20 may be particularly suited for use as a skin graft or for other medical applications which may require article 20 to have a relatively large surface area. In the fiber form, article 20 may be used for tendon/ligament/nerve repair or for other applications.

As shown in the full sequence of FIGS. 2(*a*)-(*d*), the electrochemical process utilizes an inert anode (positively charged) electrode 22 and a cathode (negatively charged) electrode 24, which are on opposite sides of a deionized water 28 containing CNT-collagen conjugates 10. Referring to FIGS. 2(*b*) and 2(*c*), to one side of an isoelectric plane 26, or the region proximate the anode 22, an acidic environment will make collagen 12 of the CNT-collagen conjugates 10 positively charged. Also referring to FIGS. 2(*b*) and 2(*c*), to a second side of the isoelectric plane 26, or the region proximate the cathode 24, a basic environment will make collagen 12 of the CNT-collagen conjugates 10 negatively charged. As best shown in FIGS. 2(*c*) and 2(*d*), CNT-collagen conjugates 10 with charged collagen molecules 12 will move to the isoelectric plane 26 where they have no charge to assemble and align into a more solid (dense) article 20 in the form of a sheet.

Figure 2D:
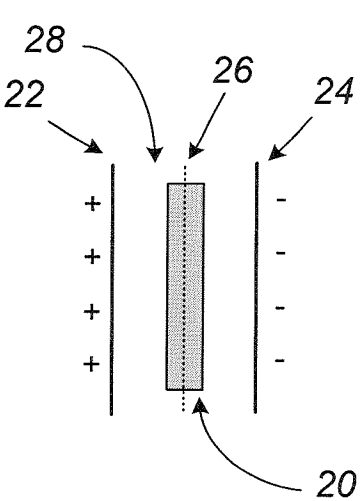
FIGS. 2*a*, 2*b*, 2*c* and 2*d* illustrate the alignment of random CNT-collagen conjugates between two electrodes during the electrochemical process to produce a CNT-collagen article with aligned collagen.
Figure 2C:
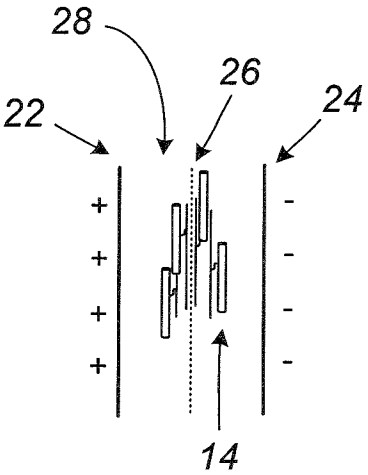
Figure 2B:
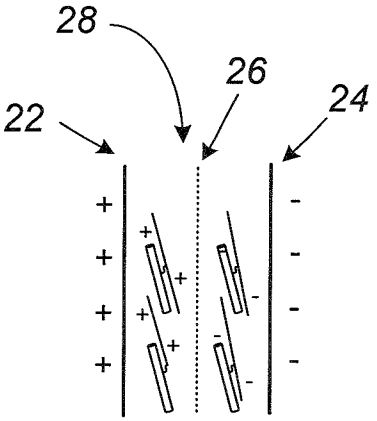
Figure 2A:
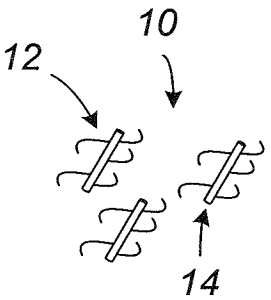
Figure 2H:
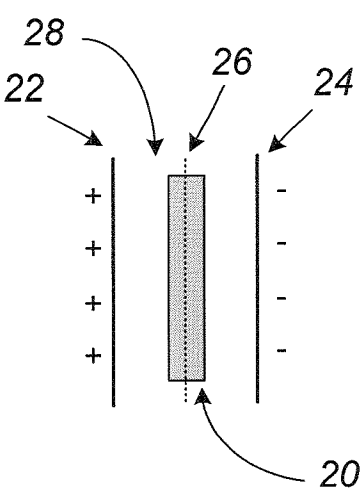
FIGS. 2*e*, 2*f*, 2*g* and 2*h* illustrate the alignment of random nanoparticle-collagen conjugates between two electrodes during the electrochemical process to produce a nanoparticle-collagen article with aligned collagen.
Figure 2G:
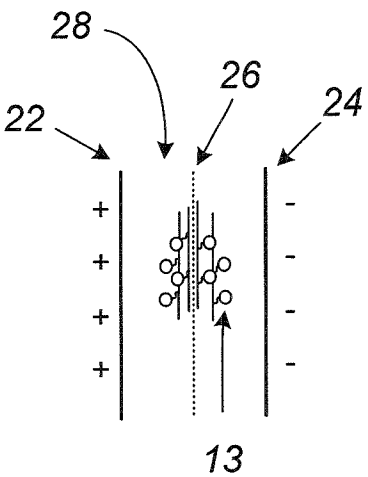
Figure 2F:
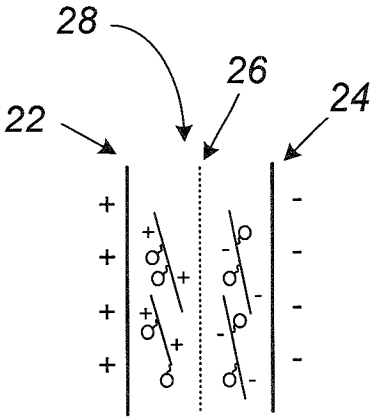
Figure 2E:
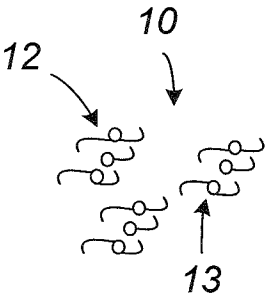

Attention is next directed to FIGS. 2*e*, 2*f*, 2*g* and *h*. As illustrated therein, the collagen conjugates may include collagen 14 in combination with nanoparticles 13. The alignment of the nanoparticles may then occur followed by formation of dense article 20 which in this situation may amount to a nanoparticle-collagen conjugate. The nanoparticles will be trapped inside the aligned polymer (e.g., collagen) structure. This allows for the ability of controlled drug release.

Figure 3:
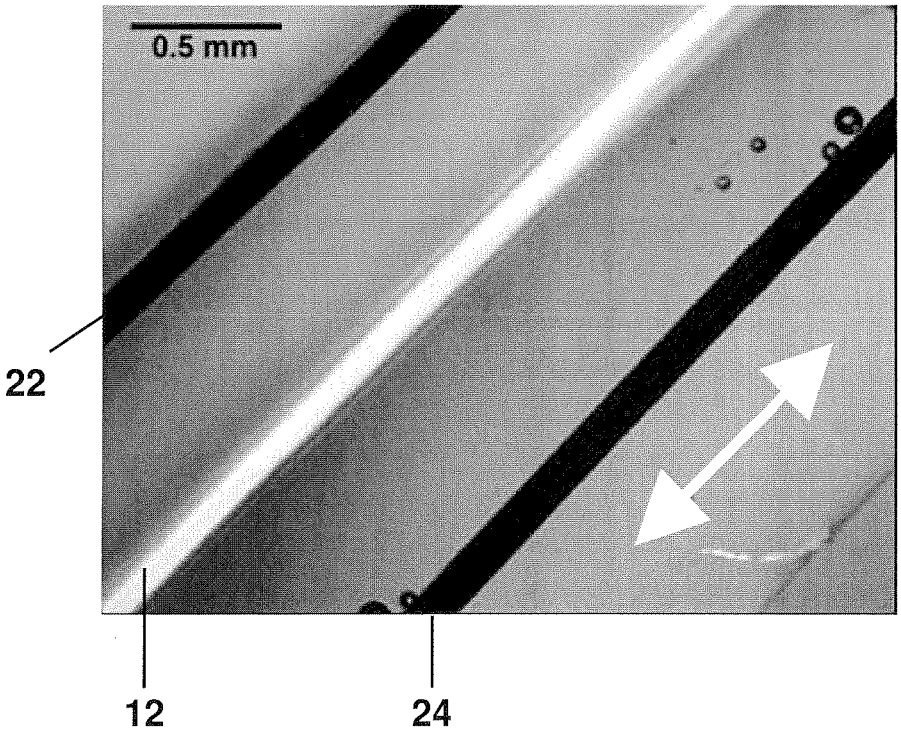
FIG. 3 shows a photograph of a pure collagen article (without CNTs) produced from the electrochemical process of FIG. 2.

Without being bound to a particular theory, it is believed that, in the presence of an electrical voltage as set forth above, the collagen 12 of the CNT-collagen conjugates 10 may align and at the same time, such alignment of the collagen 12 may result in alignment of the substrate or structure (e.g., CNTs 14) which are chemically linked to the collagen 12. In order to better understand the alignment of collagen 12 in the form of a sheet, FIG. 3 shows a photograph of an exemplary collagen article 20 in the form of a sheet and without the bound CNTs, as viewed through a compensated polarized microscope, produced from the electrochemical process of FIG. 2. From FIG. 3, it may be seen that the collagen 12 may align with the process of FIG. 2 without the presence of the CNTs 14. Self-assembly and alignment therefore provide the formation of ordered and anisotropic composite materials containing CNTs.

The aligned polymer-substrate herein may now also have CNTs 14 directionally orientated with extended lengthwise orientation. For example, the CNTs 14 may be in further arrangement end-to-end as to form substantially parallel multiple rows along the length of the structure, which may provide an intermittent layer of CNTs 14. See again, FIG. 2*c*. The rows may comprise CNTs 14 having adjacent longitudinal ends which may be in contact with one another (adjoining) or which may be separated from one another by an intermediate section of collagen 12 located there between. The CNTs 14 of adjacent rows arranged side-to-side may make contact with one another (adjoining) or be separated by an intermediate section of collagen 12.

As also illustrated in FIG. 2*c*, a second layer comprising rows of CNTs 14 may overlie a first layer of rows of CNTs 14. Similar to the first layer, the second layer may comprise CNTs 14 having adjacent ends which are in contact with one another (adjoining), or may be separated from one another by an intermediate section of collagen located there between. Also similar to the first layer, CNTs 14 of adjacent rows may make contact with one another (adjoining), or be separated by an intermediate section of collagen 12. Furthermore, CNTs 14 of the second layer and the first layer may make contact with one another (adjoining), or be separated by an intermediate section of collagen 12.

The article 20 so formed may itself have an overall wall thickness between 100 μm and 2.0 mm. For article 20 in the form of a sheet, it should be understood that the individual CNTs 14 may be tilted from the orientations as illustrated above, but still provide the general CNT pattern or arrangement of the article 20 as a whole as set forth above. In other words, for example, the CNT's making up the rows may not be perfectly parallel.

As indicated above, article 20 may attach to cathode electrode 24 during a final stage of the electrophoritic process, in which case article 20 may be peeled off or otherwise separated and removed and used as an independent stand alone sheet. Such forms of article 20 may be used as a single layer, such as for cell cultures, or spiral wound or folded for various applications, such as a skin wrap-up as a three dimensional tissue scaffold.

In other embodiments, the electrode 24 may provide a substrate to which article 20 is joined and to remain attached therewith, such as to support the article. In certain embodiments the substrate may comprise a medical device such as, for example, an implant (e.g. stent). In other embodiments, the substrate/electrode 24 may be a patterned or unpatterned substrate. Patterned substrates may include electrodes with microchannels, pores or other configurations. The substrates may also include plain wire, plates, tubes, conductive materials such as carbon, metallic material such as stainless steel, platinum, magnesium, titanium and mixtures thereof.

Attention is next directed to FIGS. 4*a*, 4*b*, 4*c* and 4*d* which respectively illustrate four electrode configurations (wire, plate, ring, tube) that can be used in the electrochemical process to produce aligned fiber bundles, sheets, rings and/or tubes of aligned polymer containing bounded substrates and/or structures.

Figure 5:
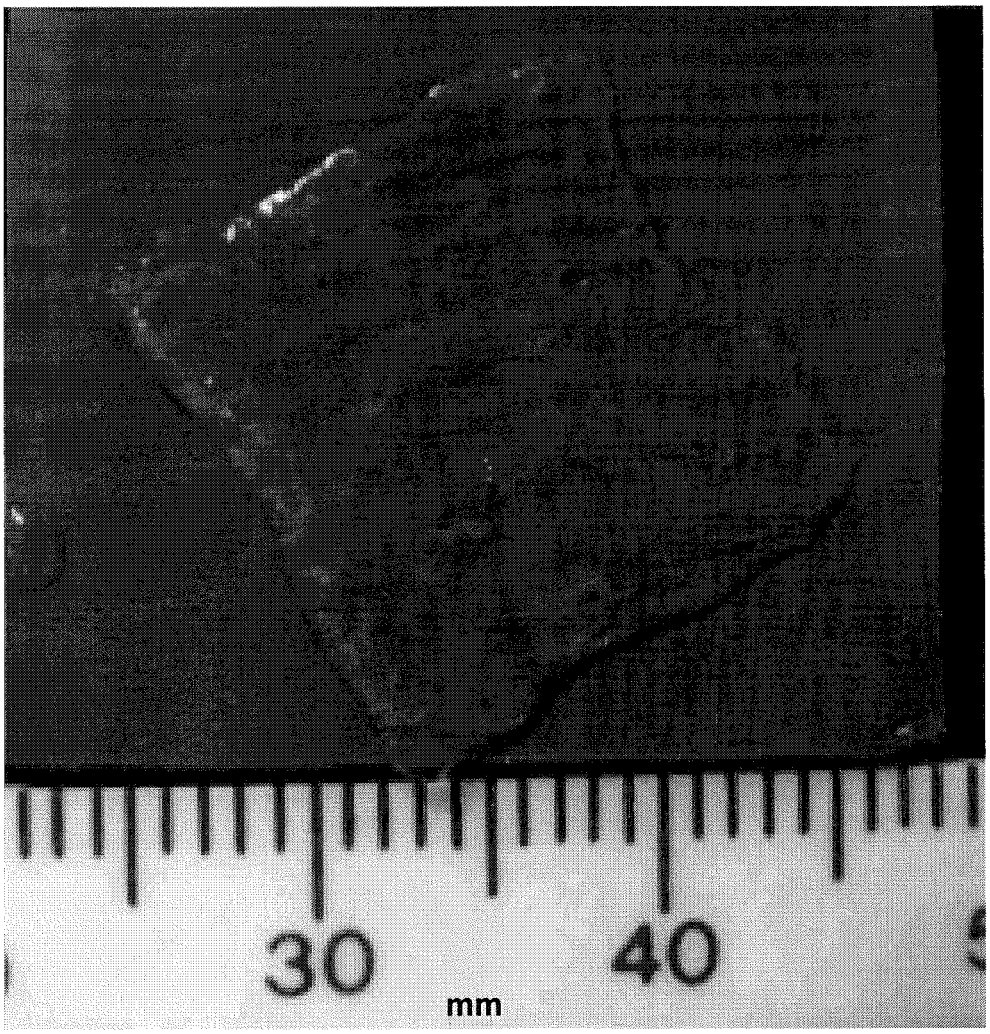
FIG. 5 shows an optical image of collagen (control) without CNTs which shows the collagen is visually transparent.
Figure 6:
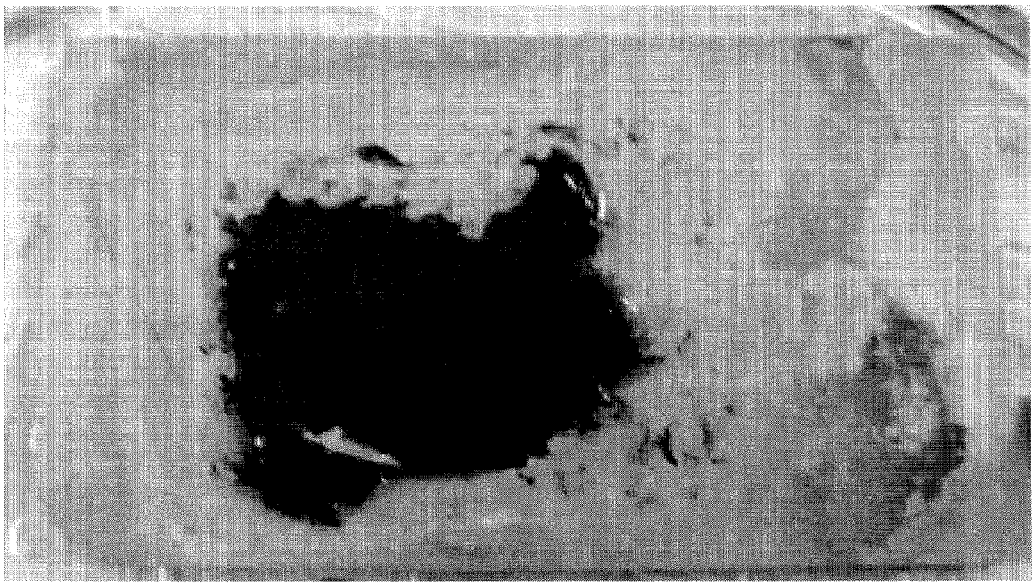
FIG. 6 shows an optical image of the CNT-collagen article.

After fabricating article 20, article 20 may then be analyzed using various techniques shown in FIGS. 5-11. FIG. 5 first shows an optical image of collagen as a control (without CNTs) which collagen was visually transparent. In contrast, FIG. 6 shows an optical image of an electrochemically prepared conjugated CNT-collagen article in the form of a sheet. As shown the article 20 is homogenous, densely packed, and black in color as compared to the collagen of control FIG. 5 without CNTs.

Figure 7:
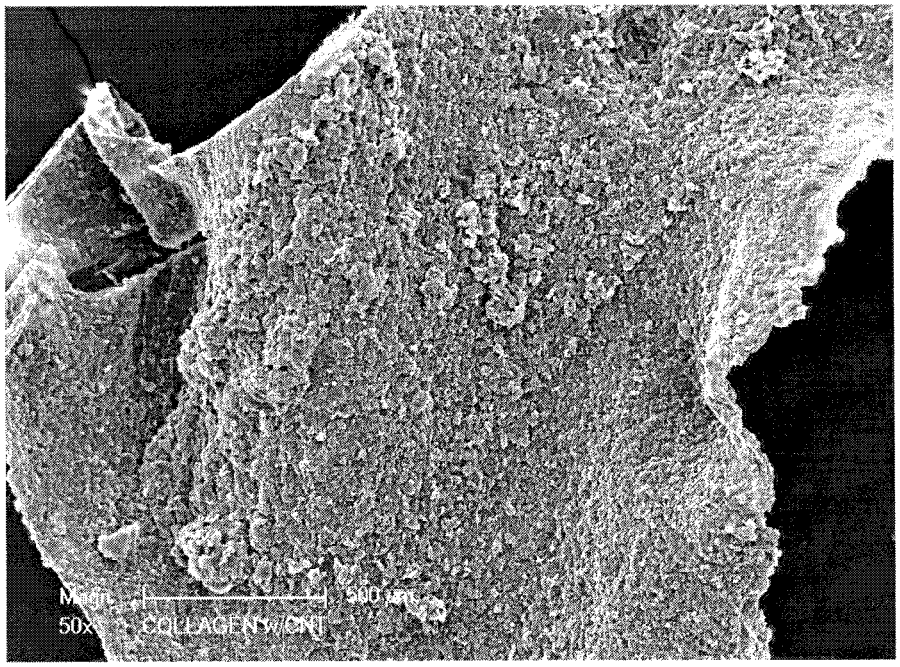
FIG. 7 is a scanning electron microscope image of the CNT-collagen article.
Figure 8:
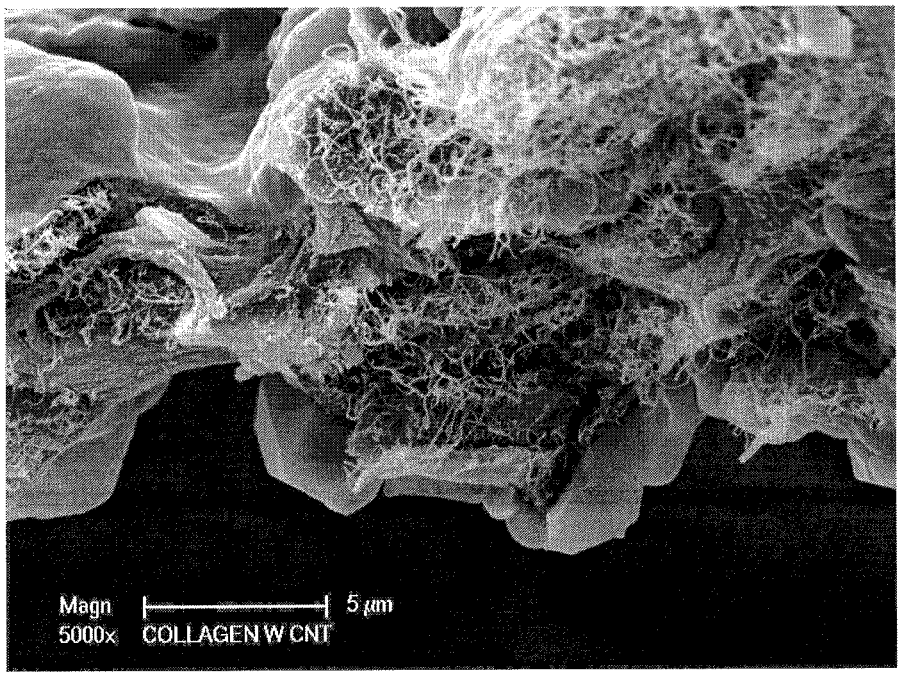
FIG. 8 is a scanning electron microscope image of the CNT-collagen article after bleaching with 1% sodium hypochlorite (NaClO) solution to partially remove the collagen and expose the embedded CNTs.

Referring to FIGS. 7 and 8, FIG. 7 shows a scanning electron microscope image of the electrochemically prepared conjugated CNT-collagen article 20 (sheet). FIG. 8 shows a scanning electron microscope image of the electrochemically prepared conjugated CNT-collagen article (sheet) after bleaching with 1% sodium hypochlorite (NaClO) solution to remove the collagen and expose the embedded CNTs. As shown from the scanning electrode microscope analysis, the CNT structure is integrated with the collagen structure.

Figure 9:
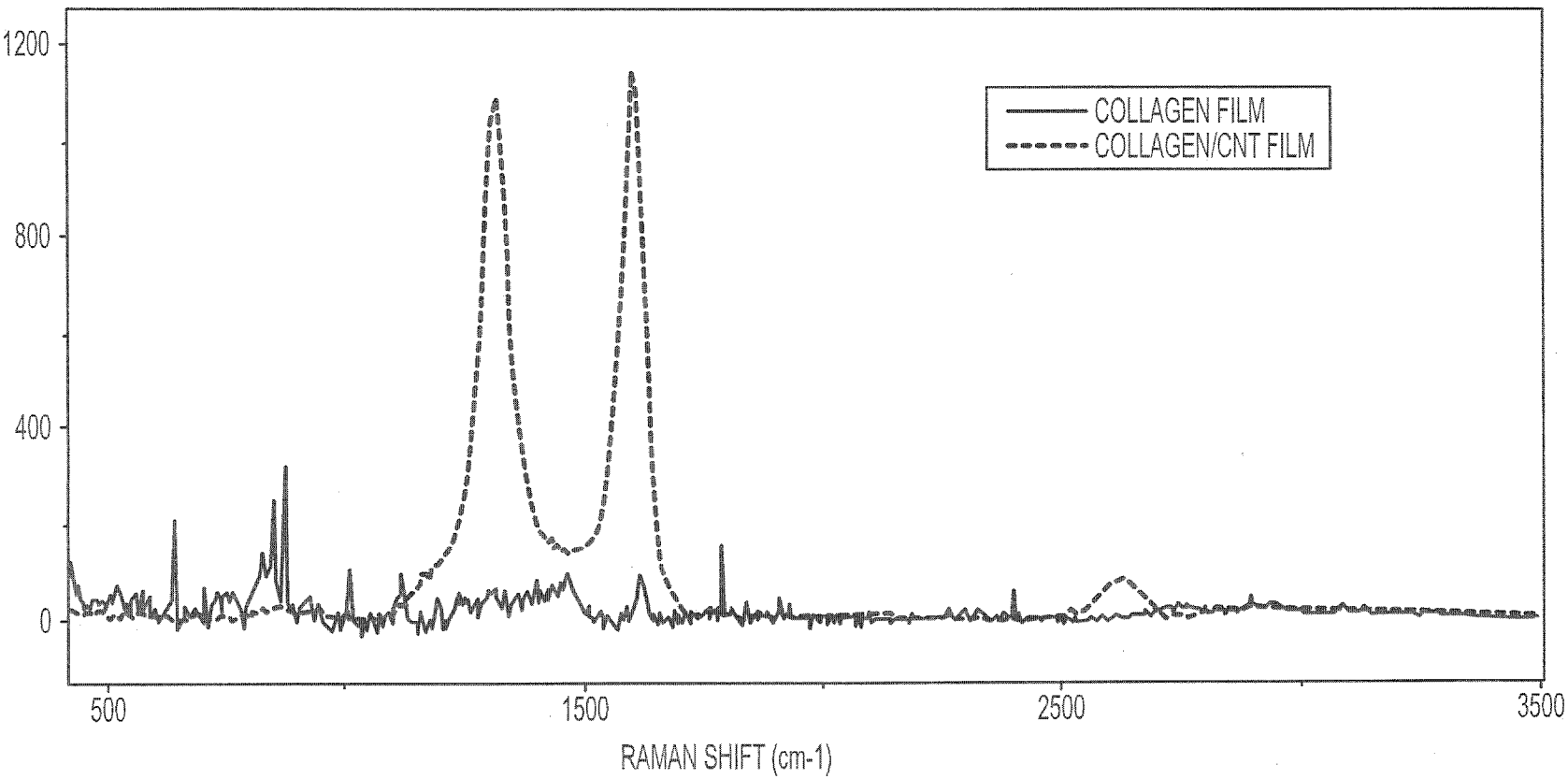
FIG. 9 shows a comparison of Raman spectrum for pure collagen in comparison with a Raman spectrum for the CNT-collagen article.

FIG. 9 shows a comparison of Raman spectrum for pure collagen 12 in comparison with the spectrum for a CNT-collagen article 20 produced from the present invention. The Raman spectrum for a CNT-collagen article 20 exhibits characteristic D and G Raman modes of CNTs, thereby confirming the presence of CNTs in article 20.

Figure 10:
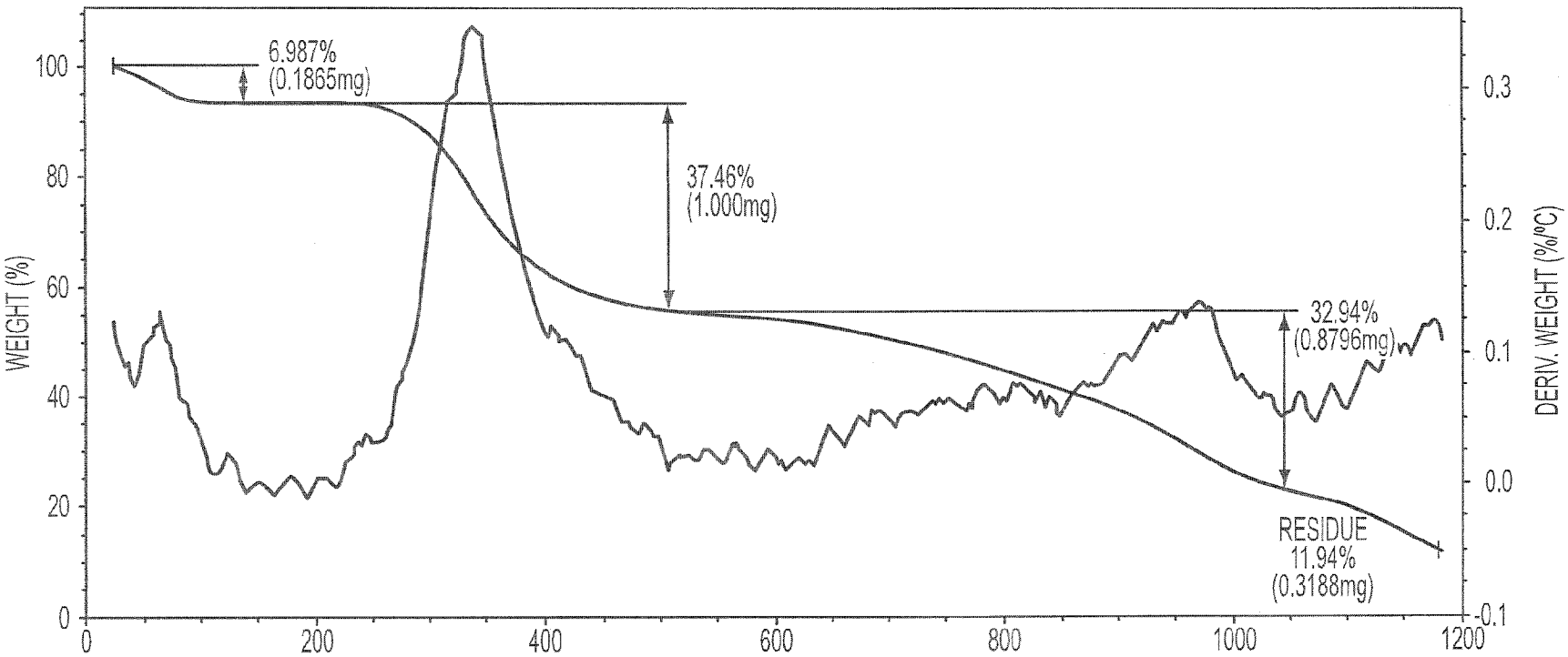
FIG. 10 shows a thermogravimetric analysis (TGA) of the CNT-collagen article.

FIG. 10 shows a thermogravimetric analysis (TGA) of the CNT-collagen article 20. In particular, article 20 comprises (by weight) about 6.99% water, 37.46% collagen, 32.94% CNTs and 11.94% residue which may be attributed to the transition metal catalysts used to grow the CNTs.

Cytotoxicity test of mesenchymal stem cells (MSCs) attached to the CNT-collagen article 20 have shown a mild degree of cytotoxicity, which is believed to be attributable to the metallic residue of the catalyst in the CNTs 14. However the MSCs proliferated and attached well to the CNT-collagen article 20.

Figure 4D:
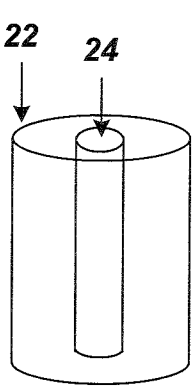
FIGS. 4*a*, 4*b*, 4*c* and 4*d* respectively illustrate four electrode configurations (wire, plate, ring, tube) that can be used in the electrochemical process to produce aligned fiber bundles, sheets, rings and/or tubes of collagen.
Figure 4C:
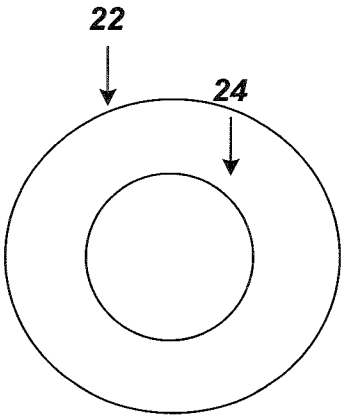
Figure 4B:
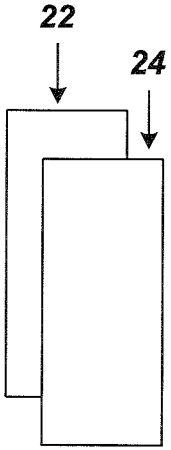
Figure 4A:
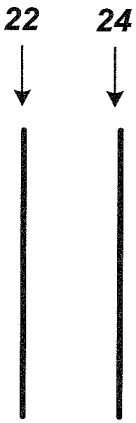

Depending on the electrode setup, article 20 with different structures can be produced from the foregoing process in addition to sheet articles. For example, with reference again to FIGS. 4*a*, 4*b*, 4*c* and 4*d*, electrodes 22 and 24 may be concentrically arranged to provide articles 20 in the form of tubular articles. More particularly, as shown in FIG. 4*d*, electrodes 22 and 24 may be circular as to produce circular tubular articles.

As with the prior embodiment, and as shown in FIGS. 11(*a*) and 11(*b*), random CNT-collagen conjugates 12 may be fed into a chamber and an electrical voltage may be applied between electrodes 22, 24. FIGS. 11(*c*) and 11(*d*) shows an exemplary aligning of the random CNT-collagen conjugates 12 between electrodes 22, 24 in the presence of the electrical voltage as CNT-collagen article 20 is fabricated. In this particular representative embodiment, electrodes 22 and 24 may comprise electrically conductive circular members and article 20 may be fabricated in the form of a tubular article. In this form article 20 may be particularly suited for use as a vascular graft and/or for applications which may require article 20 to have a tubular (hollow) shape.

As shown in FIG. 11(*a*)-(*d*), the electrochemical process may utilize a circular anode (positively charged) electrode 22 arranged within a circular cathode (negatively charged) electrode 24, which are separated by fluid 28 containing the CNT-collagen conjugates 10. Referring in FIGS. 11(*b*) and 11(*c*), inside of isoelectric plane 26, or the region proximate the anode 22, an acidic environment will again make collagen 12 of the CNT-collagen conjugates 10 positively charged. Also referring to FIGS. 11(*b*) and 11(*c*), outside of the isoelectric plane 26, or the region proximate the cathode 24 a basic environment will make collagen 12 of the CNT-collagen conjugates 10 negatively charged. As best shown in FIGS. 11(*c*) and 11(*d*), CNT-collagen conjugates 10 with charged collagen molecules 12 will move to the isoelectric plane 26 where they have no charge to assemble and align into a more solid (dense) article 20.

Figure 12:
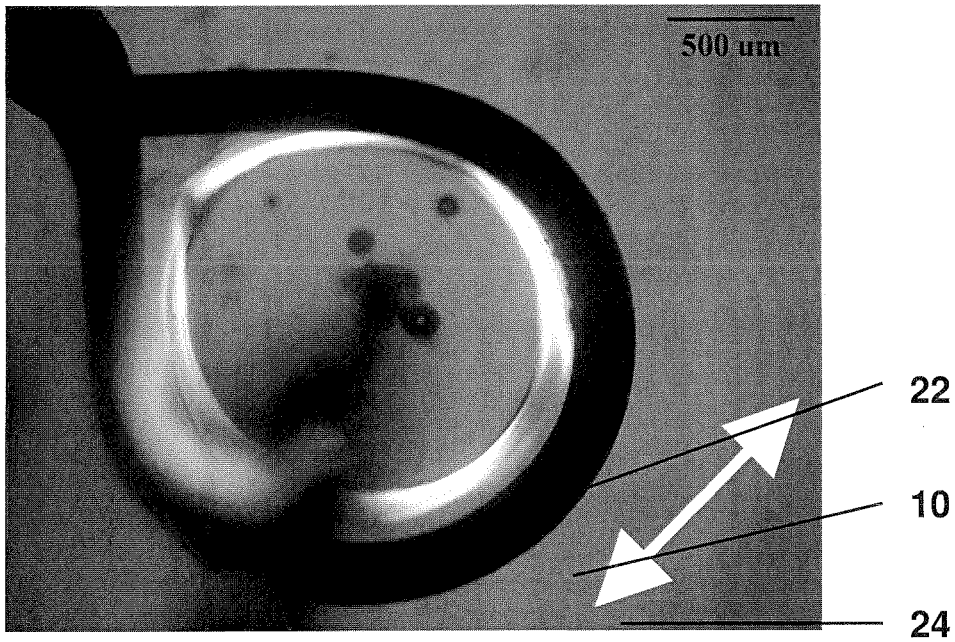
FIG. 12 shows a photograph of a collagen article (without CNTs) produced from the electrochemical process of FIG. 11.

As with the prior embodiment, and without being bound to a particular theory, it is believed that, in the presence of an electrical voltage as set forth above, the collagen 12 of the CNT-collagen conjugates 10 may align and at the same time, such alignment of the collagen 12 may result in alignment of the CNTs 14 which are chemically linked to the collagen 12. In order to better understand the alignment of collagen 12 in the form of a tubular shape, FIG. 12 shows a photograph of an exemplary collagen article 20 in a tubular shape without CNTs 14, as viewed through a compensated polarized microscope, produced from the electrochemical process of FIG. 12. From FIG. 12, it may be seen that the collagen 12 may align with the process of FIG. 12 without the existence of the CNTs 14.

Figure 11D:
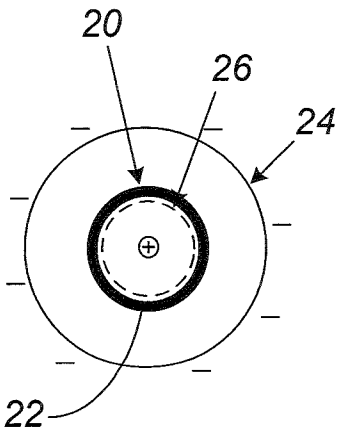
FIGS. 11*a*, 11*b*, 11*c* and 11*d* shows a schematic drawing showing a top view of an aligning of random CNT-collagen conjugates between two circular concentrically arranged electrodes during the electrochemical process to produce a CNT-collagen article in the form of a circular ring or tubular shape.
Figure 11C:
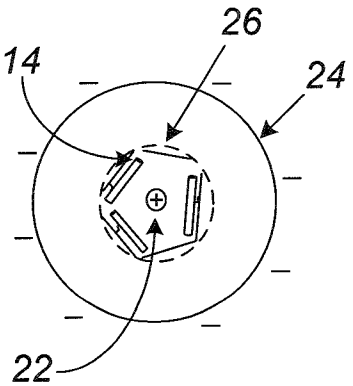
Figure 11B:
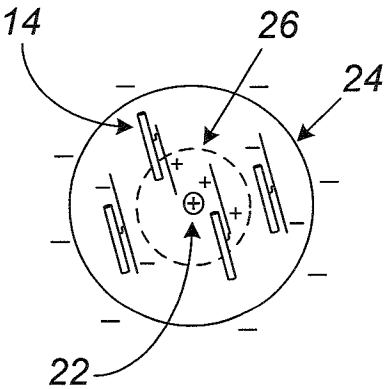
Figure 11A:
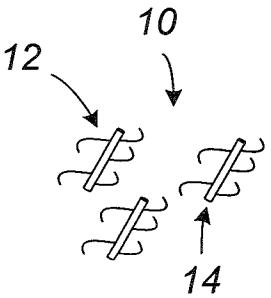

Also as with the prior embodiment, the aligned CNT-collagen conjugates 12, and more particularly article 20 in FIG. 11*d* thereof, formed at the isoelectric plane 26 may continue to migrate and attach to and provide a coating over the cathode electrode 24 during a final stage of the electrophoritic process.

Exemplary applications for tubular articles 20 may include use as connective tissue (e.g. tendons, ligaments, endoneurium) or use as vascular tissue (e.g. vascular grafts for vascular reinforcement or vascular replacement).

For articles 20 such as tubular articles, it should be understood that once again the individual CNTs 14 may be tilted from the orientations as set forth above, but still provide the general CNT pattern or arrangement of the article 20 as a whole as set forth above. Also, it should be understood that the tubular article need not be perfectly circular or cylindrical, and may be oval.

WORKING EXAMPLES

Electrochemically Prepared Collagen Sheet

Figure 13:
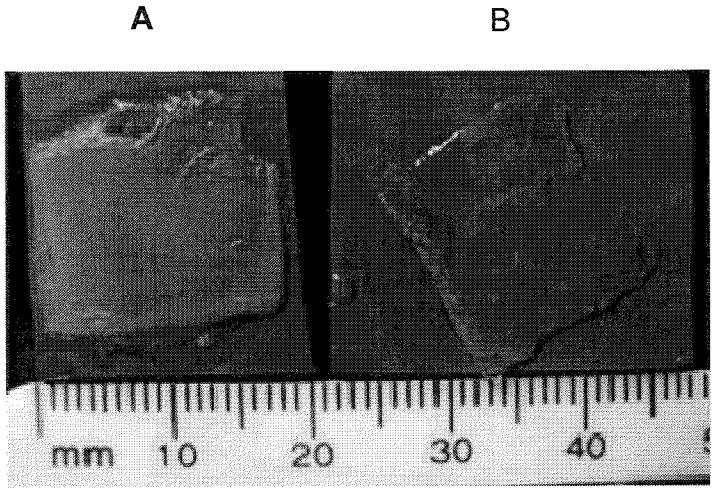
FIG. 13A is a photograph of normal random collagen.
FIG. 13B is a photograph of densely packed collagen sheet having a thickness of 400 μm.

Type 1 collagen (3 mg/mL, Davro Medical) was dialyzed against ultrapure water for 3 days at 5° C. to remove any $Cl^-$. Removal of any metal or $Cl^-$ ions is desired because they will interfere with the electrolysis of water. The dialyzed collagen was put into an electrochemical chamber which is composed of two plate-shape electrodes sealed with rubber on four sides. 5V voltage was applied between the cathode and anode. The electrolysis of water in the chamber produced a pH gradient and isoelectric focusing of the collagen. After being left overnight, a densely-packed macroscopic collagen sheet with a thickness of around 400 μm was collected from the cathode side (FIG. 13-B). Normal random collagen is shown in FIG. 13-A. For preparation of the random collagen, the same stock solution was used. However, this 3 ml stock solution was cooled to 5° C. and 0.33 mL of 0.2M phosphate neutralized solution (Davro Medical) was added to the solution and mixed on an ice/water bath. The mixture was poured into a rubber mold and allowed to gel at 37° C. in a $CO_2$-free chamber.

Figure 14B:
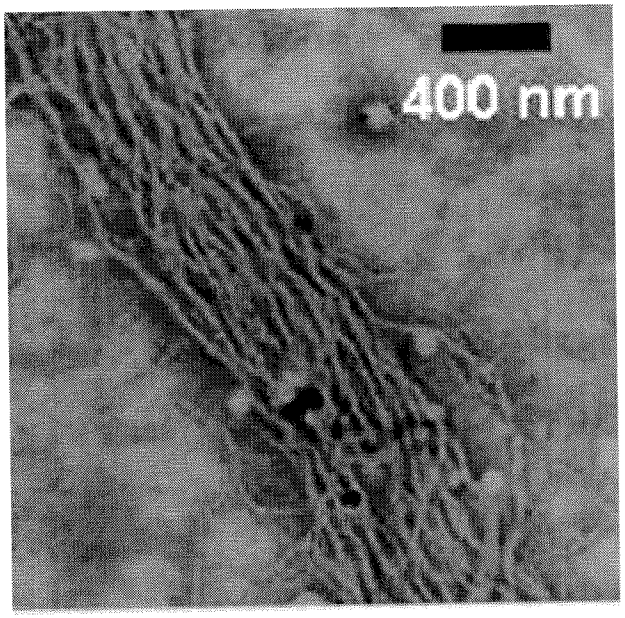
FIG. 14B shows a TEM analysis of collagen showing nanofibril diameter of the collagen synthesized by the electrochemical process herein.
Figure 14A:
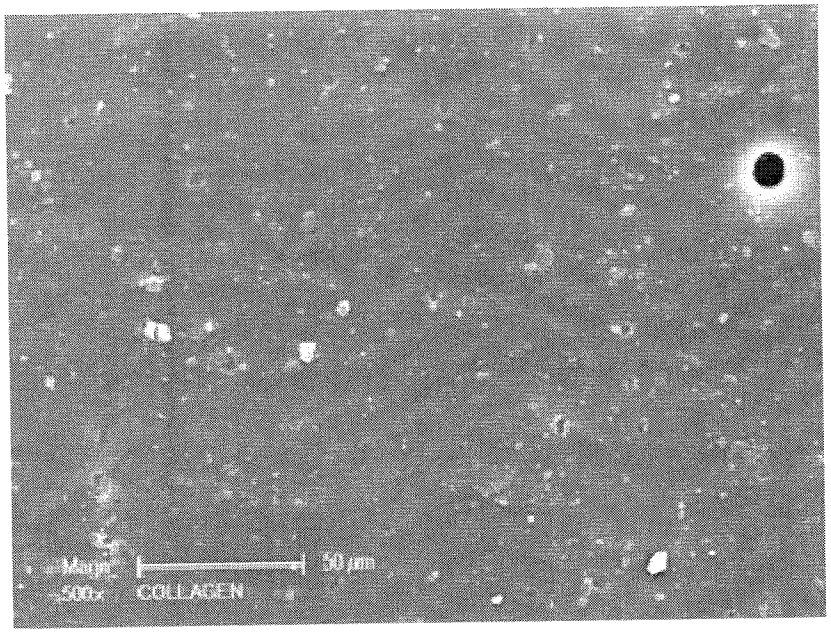
FIG. 14A is a SEM image of transparent collagen.

The electrochemically-synthesized collagen was dried, Au-coated, and imaged by SEM. For TEM analysis, a relatively small piece of the collagen sample in FIG. 3-B was macerated in a depression slide using a scalpel and forceps in ultrapure water. About 10 ml of the supernatant was put on a TEM grid and allowed to settle for 1 min. Samples were stained with 1% phosphotungstic acid and dried prior to imaging by TEM (FEI/Philips CM-100, FEI Company, Hillsboro, Oreg. FIG. 14A shows an SEM image of transparent collagen and FIG. 14B shows a TEM analysis of collagen showing nanofibril diameter of transparent collagen synthesized by the electrochemical process.

Formation of a Nanoparticle (NP)-Collagen Sheet for Drug Loading

Nanoparticles with collagen were combined to form a complex which was then fabricated into a multifunctional NP-collagen sheet by the same electrochemical process. PLGA (40 mg) and $(Asp)_4$-PEG-PLGA (60 mg) polymer, along with a drug (2 mg) was dissolved in 6 mL of methylene chloride in the oil phase. To this oil phase, 100 μl of a water phase containing fluorescence dye was introduced by ultrasonication. This water-in-oil microemulsion was further dispersed in 12 mL 1% sodium cholate solution and sonicated to form a w/o/w double emulsion. This double emulsion solution was diluted in 15 ml of 0.5% sodium cholate solution. The solvent ($CH_2Cl_2$) was removed by evaporation at room temperature and the nanoparticles of PLGA which contained drug and fluorescence dye were collected by ultracentrifugation. The resulting NPs were conjugated with collagen molecules in the presence of N-hydroxysulfosuccinimide (NHS) and ethyl-3-(3-dimethylaminopropyl)carbodiimide(EDC) overnight at 5° C. The conjugation process involves the reaction between carboxylic acid group of NPs with amine group of collagen. The conjugation was stopped overnight and the residual NHS/EDC and salt was removed by dialyzing against ultrapure water for 24 hrs. at 5° C. This NP-conjugated collagen was subject to the electrochemical process at 5V and 5 mA and a NP-collagen film was formed.

Figure 15:
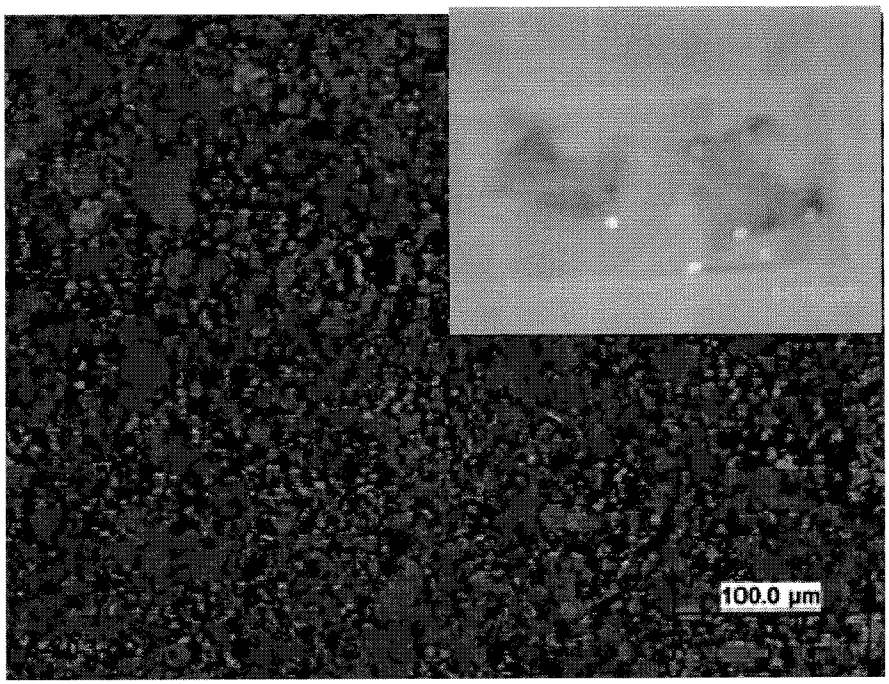
FIG. 15 provides a fluorescence image of nanoparticles loaded inside a collagen sheet. The insert shows the collagen with a standard camera.

FIG. 15 provides a fluorescence image of the nanoparticles loaded inside the collagen sheet fabricated by the above referenced electrochemical process. The insert shows an image of the collagen sheet with a standard camera. The collagen appears shaded due to the use of a rhodamine dye incorporated into the nanoparticles. Due to the high packing capacity in the collagen assembly process, nanoparticles are condensed to form micro aggregates. This result confirms that one may also incorporate drug-containing nanoparticles into the densely-packed collagen sheet by the disclosed process.

As now demonstrated herein, aligned polymers bonded to various substrates may be assembled into macroscopic sheets, tubes and fibers by using the electrochemical process disclosed herein. Self-assembly and alignment now offers the ability to produce ordered and anisotropic articles containing any bonded substrate or structure such as nanotubes and/or nanoparticles. Further, the strength of resulting aligned polymer-substrate biomaterial may be improved due to the packing density and alignment of the underlying polymer. Given these outcomes, the disclosure herein further utilizes the electrochemical process to align structures such as CNTs along with polymers such as collagen into more useful biomaterials, which can be used for drug delivery, tissue engineering and regenerative medicine.

Other advantages of the present disclosure that may now be appreciated in view of the foregoing are that the alignment process may be carried out in distilled water and therefore does not utilize toxic/hazardous solvents. In addition, as noted, the process has the ability to provide selected geometries for the aligned polymer containing the bound substrate by altering the electrode configuration (see again, FIGS. 4*a*, 4*b*, 4*c* and 4*d*). Structures contemplated for formation therefore include fibers for tendon/ligament replacement, sheets for cell culture and scaffolds and tubes for nerve guide material or relatively small diameter blood vessels.

While representative and preferred embodiments of the present invention have been described, it should be understood that various changes, adaptations and modifications can be made therein without departing from the spirit of the invention and the scope of the appended claims. The scope of the invention should, therefore, be determined not with reference to the above description, but instead should be determined with reference to the appended claims along with their full scope of equivalents. Furthermore, it should be understood that the appended claims do not necessarily comprise the broadest scope of the invention which the Applicant is entitled to claim, or the only manner(s) in which the invention may be claimed, or that all recited features are necessary.

What is claimed is:

1. A method of fabricating an aligned polymer containing a bonded substrate assembled into a biomaterial comprising:

providing a polymer in solution wherein said polymer is bound to a selected substrate;

placing said polymer solution in an electrochemical cell wherein said polymer solution is in contact with at least one electrode; and applying an electric field to said polymer solution and generating a pH gradient wherein said polymer and bonded substrate positions at the isoelectric point of the polymer in solution to form said biomaterial, wherein the electric field has an electric field strength of about 100 V/m to 30 KV/m wherein said biomaterial is in the form of a sheet, tube or fiber.

2. The method of claim 1 wherein said substrate comprises a nanotube structure having a diameter in the range of 1 nm to 999 nm.

3. The method of claim 2 wherein said nanotube comprises one of a carbon nanotube, an inorganic nanotube, a DNA nanotube or a membrane nanotube.

4. The method of claim 2 wherein said nanotube comprises one of a single wall nanotube or a multi-wall nanotube.

5. The method of claim 1 wherein said polymer includes one of an organic acid or organic base functional group and wherein said substrate includes one of an organic acid or organic base functional group and a covalent bond is present as between said polymer and said substrate due to reaction of said functional groups on said polymer and substrate.

6. The method of claim 1 wherein the polymer comprises a polypeptide.

7. The method of claim 1 wherein the polymer comprises collagen.

8. The method of claim 1 wherein the electric field has a current density of 0.3 $A/m^2$ to 34 $A/m^2$.

9. The method of claim 1 wherein said at least one electrode comprises two electrodes.

10. The method of claim 1 wherein the at least one electrode is tubular.

11. The method of claim 9 wherein the two electrodes are in a parallel configuration.

12. The method of claim 9 wherein the electrodes are in the form of plates.

13. The method of claim 1 wherein the at least one electrode is formed from carbon, stainless steel, gold, or platinum.

14. The method of claim 1 wherein said substrate comprises nanoparticles having diameters in the range of 1 nm to 999 nm.

15. The method of claim 1 wherein said substrate is a compound that is covalently bound to said polymer.

16. A method for alignment of a polymer in solution containing a bonded substrate assembled into a biomaterial comprising:

placing the polymer solution containing the bonded substrate between a first and second electrode;

applying a voltage to the first and second electrodes and producing an electric field between said electrodes wherein said electric field has an electric field strength of about 100 V/m to 30 KV/m; and aligning said polymer containing said bonded substrate at said polymer's isoelectric point to form said biomaterial wherein said biomaterial is in the form of a sheet, tube or fiber.

17. The method of claim 16 wherein said substrate comprises a nanotube structure having a diameter in the range of 1 nm to 999 nm.

18. The method of claim 17 wherein said nanotube comprises one of a carbon nanotube, an inorganic nanotube, a DNA nanotube or a membrane nanotube.

19. The method of claim 16 wherein said nanotube comprises one of a single wall nanotube or a multi-wall nanotube.

20. The method of claim 16 wherein said polymer includes one of an organic acid or organic base functional group and wherein said substrate includes one of an organic acid or organic base functional group and a covalent bond is present as between said polymer and said substrate due to reaction of said functional groups on said polymer and substrate.

21. The method of claim 16 wherein the polymer comprises a polypeptide.

22. The method of claim 16 wherein the polymer comprises collagen.

23. The method of claim 16 wherein the electric field has a current density of 0.3 $A/m^2$ to 34 $A/m^2$.

24. The method of claim 16 wherein the at least one electrode is tubular.

25. The method of claim 16 wherein the two electrodes are in a parallel configuration.

26. The method of claim 16 wherein the electrodes are in the form of plates.

27. The method of claim 16 wherein at least one electrode is formed from carbon, stainless steel, gold, or platinum.

28. A method of fabricating an aligned polymer containing a bonded substrate assembled into a biomaterial comprising:

providing a polymer in solution wherein said polymer is bound to a selected substrate; wherein the polymer comprises collagen;

placing said polymer solution in an electrochemical cell wherein said polymer solution is in contact with at least one electrode; and applying an electric field to said polymer solution and generating a pH gradient wherein said polymer and bonded substrate positions at the isoelectric point of the polymer in solution to form said biomaterial wherein said biomaterial is in the form of a sheet, tube or fiber.

* * * * *